US007710331B2

(12) United States Patent
Schillmeier et al.

(10) Patent No.: US 7,710,331 B2
(45) Date of Patent: May 4, 2010

(54) MULTILAYER ANTENNA HAVING A PLANAR DESIGN

(75) Inventors: Gerald Schillmeier, München (DE); Frank Mierke, München (DE)

(73) Assignee: Kathrein-Werke KG, Rosenheim (DE)

( * ) Notice: Subject to any disclaimer, the term of this patent is extended or adjusted under 35 U.S.C. 154(b) by 178 days.

(21) Appl. No.: 12/105,911

(22) Filed: Apr. 18, 2008

(65) Prior Publication Data

US 2009/0262024 A1 Oct. 22, 2009

(51) Int. Cl.
*H01Q 1/38* (2006.01)
*H01Q 1/24* (2006.01)

(52) U.S. Cl. ..... 343/700 MS; 343/702; 343/872

(58) Field of Classification Search ..... None
See application file for complete search history.

(56) References Cited

U.S. PATENT DOCUMENTS

| | | | | |
|---|---|---|---|---|
| 7,432,862 | B2 * | 10/2008 | Heyde | 343/700 MS |
| 2004/0027284 | A1 * | 2/2004 | Leeper et al. | 343/700 MS |
| 2005/0116875 | A1 * | 6/2005 | Yuanzhu et al. | 343/846 |
| 2005/0219131 | A1 | 10/2005 | Haidacher | |

FOREIGN PATENT DOCUMENTS

| | | | |
|---|---|---|---|
| DE | 102005054286 | A1 | 5/2007 |
| DE | 102006027694 | B3 | 9/2007 |
| DE | 102006027694 | B3 | 3/2009 |
| EP | 0 279 050 | B1 | 8/1993 |
| EP | 1616367 | B1 | 1/2007 |
| EP | 1793451 | A1 | 6/2007 |
| WO | 2007144104 | A1 | 12/2007 |

OTHER PUBLICATIONS

Anguera, Jaume, et al., "Stacked H-Shaped Microstrip Patch Antenna," IEEE Transactions on Antennas and Propagation, vol. 52, No. 4, pp. 983-993 (Apr. 2004).

Moussa, Ismael K., et al., "Analysis of Stacked Rectangular Microstrip Antenna," 24th National Radio Science Conference (NRSC 2007), Faculty of Engineering, Ain shams Univ., Egypt (Mar. 13-15, 2007).

First examination report issued by the German Patent Office in corresponding German patent application (Feb. 10, 2009).

Search Report issued by European Patent Office in corresponding PCT application PCT/EP2009/002234 (Aug. 7, 2009).

* cited by examiner

*Primary Examiner*—Trinh V Dinh
(74) *Attorney, Agent, or Firm*—Nixon & Vanderhye PC

(57) ABSTRACT

An improved multilayer antenna has patch assembly divided at least into two. It comprises, in addition to the primary patch element, a secondary patch additional element. The patch element and the patch additional element can be positioned toward one another and at least partly in one another to change the overall height thereof. The patch additional element is held by a separate holding and support means, preferably by a hood covering the entire antenna assembly.

20 Claims, 4 Drawing Sheets

MULTILAYER ANTENNA HAVING A PLANAR DESIGN

The invention relates to a multilayer antenna having a planar design as claimed in the pre-characterizing clause of claim 1.

A generic multilayer antenna has become known from DE 10 2006 027 694 83.

The multilayer antenna having a planar design comprises in this case an electrically conductive earth surface, a conductive radiation surface (which is arranged with parallel spacing from the earth surface) and also a dielectric carrier which is sandwiched between the earth surface and the radiation surface. A support means, on which an electrically conductive patch element is positioned, is arranged above the radiation surface. The support means for the patch element has a thickness or height which is less than the thickness or height of the patch element.

The patch element itself can be configured as a volume body, i.e. as solid material. It is also possible for the patch element to consist of a metal plate or a metal sheet which is provided, for example by cutting or punching, with peripheral webs, edges or the like extending away from the dielectric carrier.

An antenna of this type is particularly suitable as a motor vehicle antenna, including for example for SDARS services. For this purpose, a patch antenna of this type can be provided in addition to further antenna radiators for other services on a common base assembly on antenna structures which are separate from the base assembly and generally protrude vertically upward.

An overall antenna assembly of this type is then located below a hood, such as is known for example from EP 1 616 367 B1.

In antenna assemblies of this type, for example using a patch antenna known from DE 10 2006 027 694 B3, which was mentioned at the outset, care must be taken to ensure that certain tolerances are adhered to. This certainly requires the availability of an additional small dimension of from 1-2 mm as tolerance compensation to avoid insufficient internal space within a hood. However, in hood-shaped covers, overall this certainly leads to a perceptible increase in the size of the hood as a whole, as even a small increase in the minimum height leads overall, owing to a specific curved configuration of the hood, to an undesirable widening and lengthening of the hood housing.

The object of the present invention is therefore to develop a further improved multilayer antenna having a planar design that allows a reduction in the tolerances to be adhered to even in the case of optimum antenna reception.

According to the invention, the object is achieved in accordance with the features disclosed in claim 1. Advantageous embodiments of the invention are disclosed in the sub-claims.

The multilayer antenna having a planar design corresponds basically to the construction known from DE 10 2006 027 694 B3. In this respect, reference is made to the disclosure of the above-mentioned prior publication and to the content of the present application.

The improvement may now be achieved as a result of the fact that the parasitic patch, which is provided on the planar patch antenna above the support means 19, is now divided at least into two and comprises a first patch element and also a patch additional element. In order to vary the overall height of the two patch elements, the elements can be collapsed telescopically to differing degrees; preferably, one patch element can dip into the other to differing degrees. One patch element may in this case preferably be configured in a box-shaped or box-like manner, preferably with a peripheral and upwardly open edge. The second patch element, which will be referred to hereinafter in some cases also as the patch additional element, may consist of or comprise a volume body or, for example, a likewise box-shaped radiation element, thus allowing both patch elements to be moved toward one another in a differing position in which one patch element, as it were, "dips" in the other by a certain height. In other words, preferably at least one of the two patch elements should therefore have a length and/or a width which is preferably at least slightly less than the internal dimension of the second patch element which is provided with a peripheral or generally peripherally closed edge [and can] if required dip therein to a certain degree. In this case, the further patch additional element pertaining to the parasitic radiator arrangement can, as mentioned, be provided as a volume body or else as a box-shaped element which is preferably downwardly open. However, in this case, the lower patch element can in particular also be equipped as a volume body or as a box-shaped patch element which is, for example, even downwardly open and can dip into the upper patch additional element, especially if it is configured to be slightly smaller (i.e. in the longitudinal and transverse directions) than the upper patch additional element.

This patch additional means is now fastened to the inside of the hood, which overlaps the entire antenna assembly, and/or is held thereby, in such a way that this patch additional means rests directly above the patch assembly which is located on the support means. Viewed from the side, there should in this case preferably be no interval between the edges or webs of the patch assembly, which is located on the support means, and the patch additional means located thereabove. However, in the event of differences in tolerance, it is then quite possible for the upper patch additional means to dip to differing degrees into the box-shaped patch element located on the carrier means, or else a gap is formed between the two.

In principle, the assembly can also be inverted in such a way that, for example, the patch element which is Fastened to the hood is made larger and provided with the aforementioned generally closed peripheral edge or web and in this case, if required, overlaps to differing degrees as required the patch element which is located therebelow and held by way of the actual patch antenna.

Overall, this assembly according to the invention allows the height of the hood to be reduced, as no additional (albeit only slight) height dimension must be provided for differences in tolerance. If there are differences in tolerance, this merely means that the patch element, which is held on the inside of the hood, can reach to differing degrees into the box-shaped patch assembly which is located therebelow and rests on the support means.

However, from the point of view of electrics, this split patch functions like the one-piece patch element described in the generic prior art according to DE 10 2006 027 694 B3.

Further advantages, details and features of the invention will emerge from the following discussion of the invention. In the individual drawings.

Reference will now firstly be made to the exemplary embodiment according to FIGS. 1 to 4 showing a patch antenna which has surfaces and layers arranged one above another along an axial axis Z. In principle, a patch element of this type is known from DE 10 2006 027 694 B3, to the full disclosure of which reference is made. Nevertheless, the patch element known from DE 10 2006 027 694 does not have a split parasitic patch assembly comprising a patch additional element according to the invention.

Figure 1:
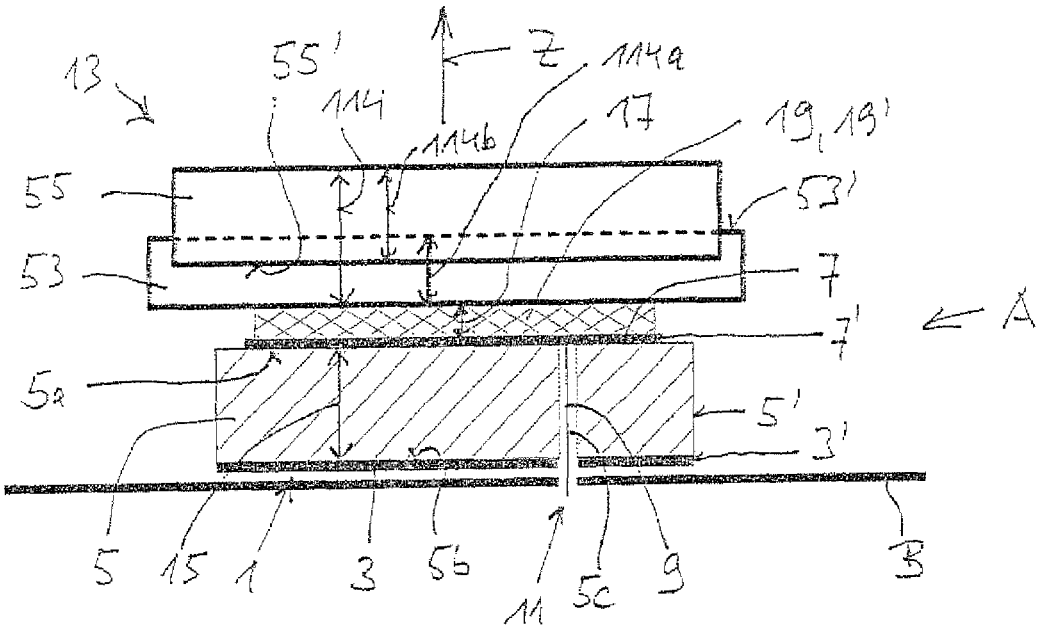
FIG. 1 is a cross section through a multilayer antenna according to the invention, in particular a patch antenna comprising a patch additional element which is additionally provided in accordance with the invention.
Figure 2:
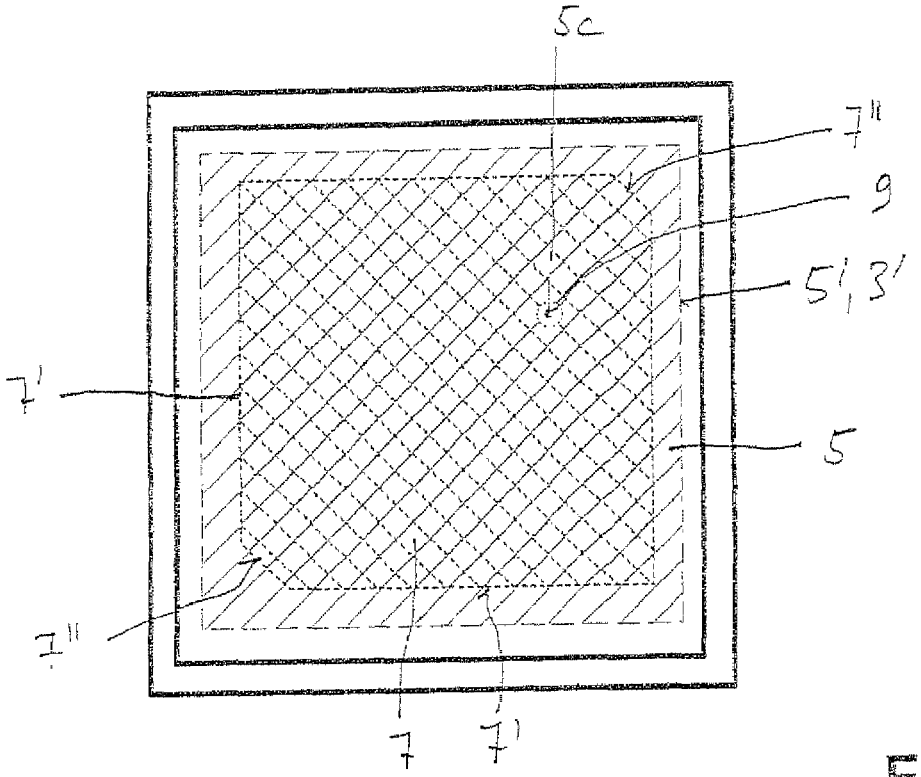
FIG. 2 is a schematic plan view onto the exemplary embodiment according to FIG. 1.

The schematic cross section according to FIG. 1 shows that the patch antenna A has on what is known as its underside or mounting side 1 an electrically conductive earth surface 3. Arranged on the surface 3 or laterally offset therefrom is a dielectric carrier 5 which, in plan view, conventionally has an outer contour 5' corresponding to the outer contour 3' of the earth surface 3. This dielectric carrier 5 can however also be larger or smaller and/or provided with an outer contour 5' differing from the outer contour 3' of the earth surface 3. In general, the outer contour 3' of the earth surface can be n-polygonal and/or even provided with curved portions or be curved in its configuration, although this is unconventional.

The dielectric carrier 5 comprising an upper side 5*a* and a lower side 5*b* has a sufficient height or thickness which generally corresponds to a multiple of the thickness of the earth surface 3, i.e. in contrast to the earth surface 3, which roughly consists merely of a two-dimensional surface, the dielectric carrier 5 is configured as a three-dimensional body having sufficient height and thickness.

As an alternative to the dielectric body 5, a different type of dielectric or a different type of dielectric construction can also be provided, for example using air or with a layer of air next to a further dielectric body. If air is used as the dielectric, then obviously a corresponding carrier means, comprising for example stilts, bolts, columns, etc., must then obviously be provided to carry and to hold the further parts of the patch antenna which are located thereabove and will be described hereinafter.

An electrically conductive radiation surface 7, which can likewise again roughly be conceived of as a two-dimensional surface, is configured on the upper side 5*a* opposing the underside 5*b* (which comes to lie adjacent to the earth surface 3). This radiation surface 7 is electrically powered and excited via a feed line 9 which extends preferably in the transverse direction, in particular perpendicularly to the radiation surface 7 from below through the dielectric carrier 5 in a corresponding hole or a corresponding channel 5*c*.

From a connection point 11 which is generally located at the bottom and to which a coaxial cable (not shown in greater detail) can be connected, the inner conductor of the coaxial cable (not shown) is then electrically connected to the feed line 9 and thus to the radiation surface 7. The outer conductor of the coaxial cable (not shown) is then electrically connected to the earth surface 3 which is located at the bottom.

The exemplary embodiment according to FIG. 1 ff. shows a patch antenna having a dielectric 5 and a square shape viewed from above. This shape or the corresponding contour or outline 5' can however also differ from the square shape and generally have an n-polygonal shape. Although unconventional, even curved outer delimitations may be provided.

The radiation surface 7 resting on the dielectric 5 can have the same contour or outline 7' as the dielectric 5 located therebelow. In the exemplary embodiment shown, the basic shape is likewise formed so as to be square, in adaptation to the outline 5' of the dielectric 5, although it has at two opposing ends flattenings 7" formed, as it were, as a result of the omission of an isosceles-rectangular triangle. Generally, the outline 7' may therefore also be an n-polygonal outline or contour or even be provided with a curved outer delimitation 7'.

The aforementioned earth surface 3, although also the radiation surface 7, is sometimes referred to as a "two-dimensional" surface, as its thickness is so low that it is scarcely possible to describe it as a "volume body". The thickness of the earth surface and the radiation surface 3, 7 is conventionally less than 1 mm, i.e. generally less than 0.5 mm, in particular less than 0.25 mm, 0.20 mm, 0.10 mm.

The patch antenna A described hereinbefore can, for example, consist of a conventional commercial patch antenna, preferably of what is known as a ceramic patch antenna in which, that is to say, the dielectric carrier layer 5 is made of a ceramic material. As will become apparent from the remainder of the description, there may also be configured, beyond the patch antenna A described hereinbefore, a patch antenna in the sense of a stacked patch antenna in which there is additionally provided, with lateral of vertical offset from the upper radiation surface 7, a patch assembly 13 comprising a first primary patch element 53 and a second secondary patch additional element 55. In this case, the first parasitic patch element 53 is configured in such a way that it has, compared to the aforementioned earth surface 3 and the radiation surface 7, a three-dimensional structure with a differing, i.e. greater, height or thickness.

Preferably, use is made of a support means 19 having a thickness or height 17, in particular a dielectric support means 19, via which the primary patch element 53 is held and supported. This dielectric support means 19 consists preferably of an adhesion or mounting layer 19' (FIG. 6) which can be configured, for example, as what is known as a double-sided adhesive adhesion and mounting layer 19'. For this purpose, use may be made of conventional commercial double-sided adhesive tapes or double-sided adhesive foam strips, adhesive pads or the like having an appropriate, above-mentioned thickness. This easily allows the aforementioned patch element 53 to be fastened and mounted on the upper side of a conventional commercial patch antenna, in particular a conventional commercial ceramic patch antenna.

The stacked patch antenna as described is positioned on a chassis B which in FIG. 1 is indicated merely as a line and may, for example, be the base chassis for a motor vehicle antenna in which the antenna according to the invention may if appropriate be integrated in addition to further antennas for other services. The stacked patch antenna according to the invention can for example be used, in particular, as an antenna for geostationary positioning and/or for the reception of satellite or terrestrial signals, for example of what is known as the SDARS service. There are, however, no restrictions preventing use for other services also.

The primary patch element 53 can, for example, consist of an electrically conductive, upwardly open, box-shaped metal body having appropriate longitudinal and transverse extensions and sufficient height.

Figure 3:
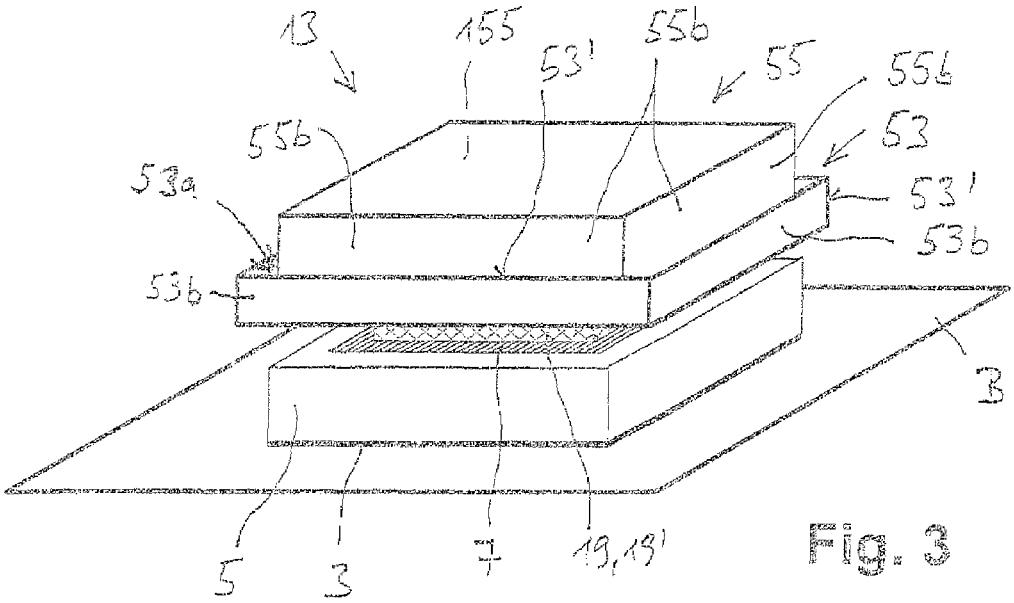
FIG. 3 is a schematic three-dimensional view of the patch antenna according to the invention with a primary patch element which is configured in the manner of an open box and into which a patch additional element dips.
Figure 4:
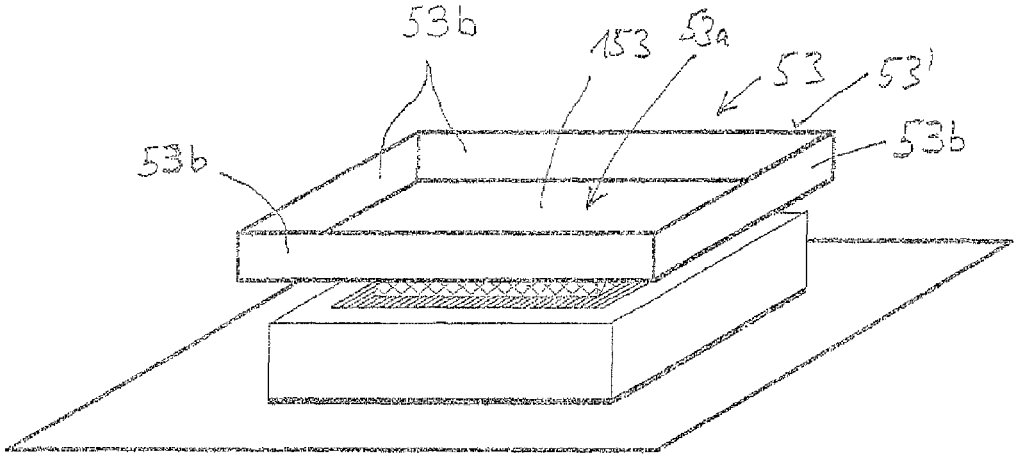
FIG. 4 is a view corresponding to FIG. 3, although without the further patch additional element.

As may be seen from the three-dimensional view according to FIGS. 3 and 4, this patch element 53 can have a rectangular or square structure with a corresponding outline 53'.

In the exemplary embodiment shown, the patch element 53 has a longitudinal extension and a transverse extension which, on the one hand, are greater than the longitudinal and transverse extensions of the radiation surface 7 and/or, on the other hand, are also greater than the longitudinal and transverse extensions of the dielectric carrier 5 and/or of the earth surface 3 located therebelow.

As may be seen from the figures, the parasitic patch assembly 13 is divided into two and comprises the primary patch element 53 which rests on the carrier means 19 or is fastened and held thereon and is configured in the manner of an upwardly open box and comprises a base surface or central surface 153 which, in the exemplary embodiment shown, is provided with a peripheral edge or a peripheral web 53*b* (that is to say, generally a corresponding elevation 53*b*) which rises transversely, in particular perpendicularly, from the plane of the base surface 153 which is also parallel to the earth surface. A patch element 53 of this type can, for example, be produced by cutting and tilting from an electrically conductive metal sheet, wherein the peripheral webs 53*b* can be electrically connected to one another in the corner regions, for example by soldering (wherein recesses may furthermore also be provided in the central region 153, as will be examined in greater detail hereinafter).

The secondary patch additional element 55, which in the exemplary embodiment shown is likewise box-shaped, in the manner of a volume body having a corresponding length and width and height, is then located above this primary patch element 53. The configuration of the length and width is such that the dimensions are, for example, at least slightly smaller than the free inner length and transverse length between the peripheral webs 53*b* of the primary patch element 53. That is to say, this allows the secondary patch element, i.e. the secondary patch additional element 55, to dip to differing degrees into the interior 53*a* of the lower patch element 53. In other words, the lowest level, i.e. the bottom delimiting plane 55' comes to lie in the interior 53*a* of the primary patch element 53, i.e. below the upper delimiting plane 53' which is defined by the upper peripheral rim of the webs or edges or outer walls 53*b*.

However, as an alternative to a volume body formed in this way, the secondary patch additional element 55 can also be configured in such a way that it is formed, like the lower patch element 53, in the manner of an open box with an interior 55*a* (see FIGS. 5 and 6) and with a peripheral edge or a peripheral web 55*b* (generally a peripheral elevation 55*b*), i.e. this secondary patch additional element 55 points downward with its opening side and is closed off by the upper base 155.

The patch additional element 55 thus described is now held by a separate support means 61, preferably in the form of a hood or housing 61' covering and receiving the antenna.

Figure 5:
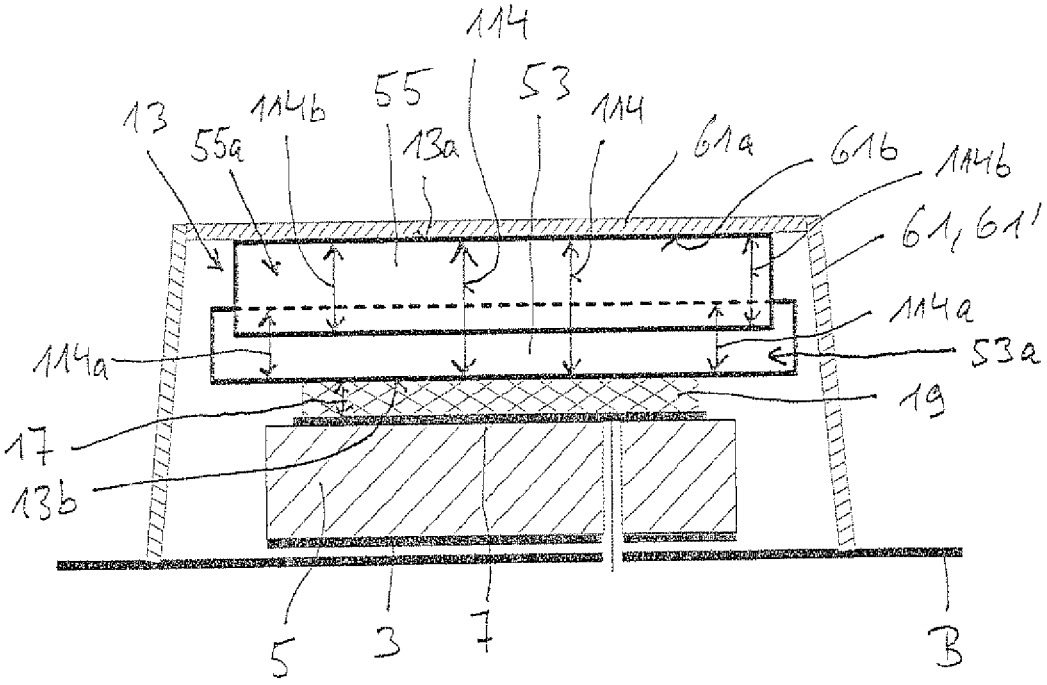
FIG. 5 is a schematic cross section through the exemplary embodiment represented in FIG. 3 with a hood covering the entire assembly.

FIG. 5 is in this case a perpendicular section of a first schematic exemplary embodiment transversely to the earth plane or transversely to the radiation planes of the patch antenna in which the secondary patch additional element 55 is held and fastened with its upper side 13*a*, which is formed by the base surface or central surface 155, on the top hood upper side 61*a*, which in this exemplary embodiment is flat in its configuration, on the inside 61*b* located there, for example by adhesion, by a separate locking or fixing mechanism, etc.

This embodiment allows tolerance errors easily to be compensated for as a result of the fact that this patch additional element 55 can dip into the lower primary patch element 53 to differing degrees depending on the resulting overall construction of the patch antenna, including the primary patch element 53 and the patch additional element 55, and also depending on the height of the hood 61 and the available internal dimension below this hood 61. This allows tolerance errors to be compensated for.

Figure 6:
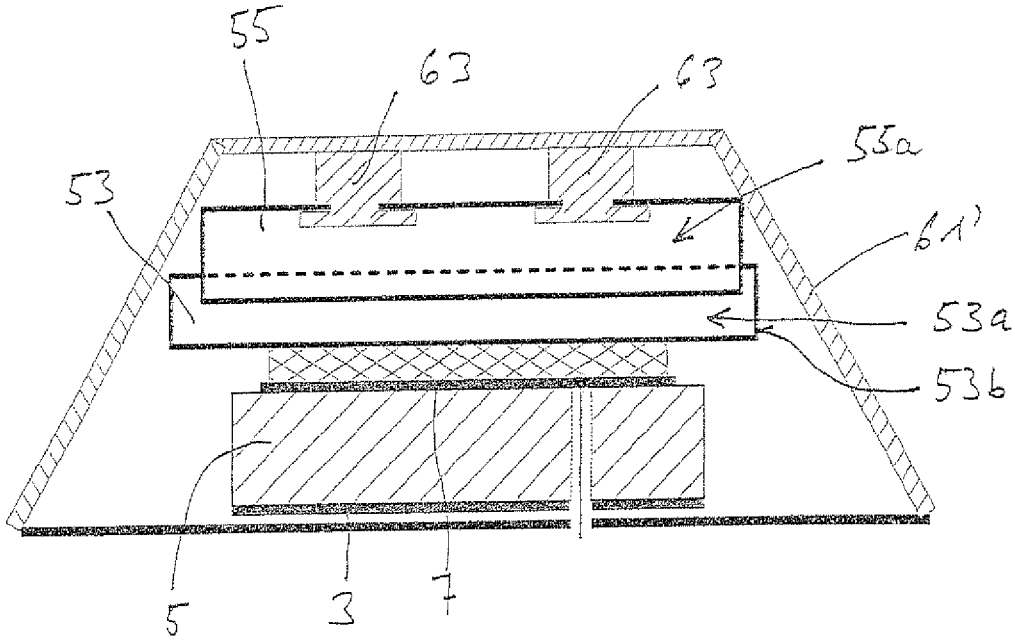
FIG. 6 is a cross section differing from FIG. 5 with a differing hood geometry and a different type of holding means for the patch additional elements.

The variation according to FIG. 6 shows a differently configured hood which is more trapezoidal in cross section. In this case, the upper patch additional element 55 is suspended from the upper side 61*a* of the hood via a separate support means 63. Any desired mechanical holding and/or locking and/or clamping mechanisms may in this case be used to support and fix the upper patch additional element accordingly.

It may therefore be seen from the illustrated construction that it is entirely possible for the overall height 114 of the patch assembly 13 to vary in accordance with the differing tolerance conditions. This is achieved as a result of the fact that the patch assembly 13 is divided at least into two and comprises the two components which may if appropriate be positioned at differing relative distance from one another namely the patch element 53 and the patch additional element 55.

The thickness of the patch assembly 13 as a whole should preferably have a dimension which is not just twice, 3, 4 or 5 times, etc. but rather above all 10 times, 20, 30, 40, 50, 60, 70, 80, 90 and/or 100 and more times the thickness of the earth surface 3 and/or the thickness of the radiation surface 7.

In the exemplary embodiment shown, the thickness or height 114 of the patch assembly 13 as a whole is equal to or greater than a distance 17 between the underside of the patch element 53 and the upper side of the radiation surface 7. On the other hand, this distance should also be not less than 0.5 mm, preferably greater than 0.6 mm, 0.7 mm, 0.8 mm, 0.9 mm or equal to or greater than 1 mm. Values of about 1.5 mm, i.e. generally between 1 mm and 2 mm or 1 mm and 3 mm, 4 mm or up to 5 mm are entirely sufficient.

Furthermore, it may also be seen that the height or thickness 114 of the three-dimensional patch assembly 13 is preferably less than the height or thickness 15 of the dielectric carrier 5. Preferably, the overall thickness or overall height 114 of the patch assembly 13 has a dimension corresponding to less than 90%, in particular less than 80%, 70%, 60%, 50% or even less than 40% and if appropriate 30% or less than 20% of the height or thickness 15 of the carrier element 5.

In addition, no limitation need necessarily be placed on the above-mentioned height. Therefore, the height or thickness 114 of the three-dimensional patch assembly 13 can also have a greater, and above all much greater, height or thickness than the thickness or height 15 of the dielectric carrier 5. In other words, this height or thickness 15 of the carrier element 5 may, for example, also have a dimension corresponding to up to 1.5 times, 2 times, 4, 5, 6, 7, 8, 9 and/or 10 and more times the height or thickness 15 of the carrier element 5.

On the other hand, the thickness or height 114 of the patch assembly 13 as a whole should preferably be greater than the distance dimension 17 between the radiation surface 7 and the underside 13*b* of the patch element 13.

The height 114*a* of the lower patch element 53 and the height 114*b* of the upper patch additional element 55 are preferably the same so as to allow maximum tolerance compensation. Preferably, at least the two individual heights 114*a* and 114*b* (FIG. 5) with respect to the patch element 53 should differ from one another relative to the patch additional element 55 by less than 50%, in particular less than 40%, 30%, 20%, in particular less than 10%.

Obviously, the upper patch additional element 55 is also electrically conductive or provided on its outside or if appropriate with a cavity body having a conductive inside. Therefore, this body may likewise consist of metal or of a plastics material or a dielectric body which is coated if appropriate with an electrically conductive layer. In practice, use may in this case be made of an installation within a hood in which the upper second patch element 55 optionally comes to lie with its lower delimiting plane 55 only at the level of the upper delimiting plane 53' of the lower patch element 53, or even is positioned slightly thereabove.

Merely for the sake of completeness, it should also be noted that the overall construction of the lower and upper patch elements may also be inverted in such a way that, for example, the upper patch element 55, the outer contours of which are smaller, is constructed on the carrier means 19 and the patch element 53, which is shown at the bottom in the figures, is fastened and/or held to a hood; that is to say, in other words, the patch element which is then on top overlaps the lower patch element, and the lower patch element can dip in the upper patch element. However, this would lead to an increase in the size of the dimensions of the hood, and this is in principle less desirable.

In principle, it should also be noted that one respective part of the patch assembly 13 as a whole, which part is smaller and can dip into the other respective patch element or patch additional element (which is configured in the manner of an open box), may be configured as a volume body (i.e. a solid body) or likewise as a box which is open toward one side. In this case, the open side of the box-shaped patch element 53 or patch additional element 55 thus configured lies preferably in each case on the side facing the other patch element. In other words, the open sides of the patch element 53 and of the patch additional element 55 therefore lie on the two mutually facing sides. In principle, the opening side may, in particular in the case of the smaller patch additional element 55, also be configured on the side which is remote from the patch element 53.

Figure 7:
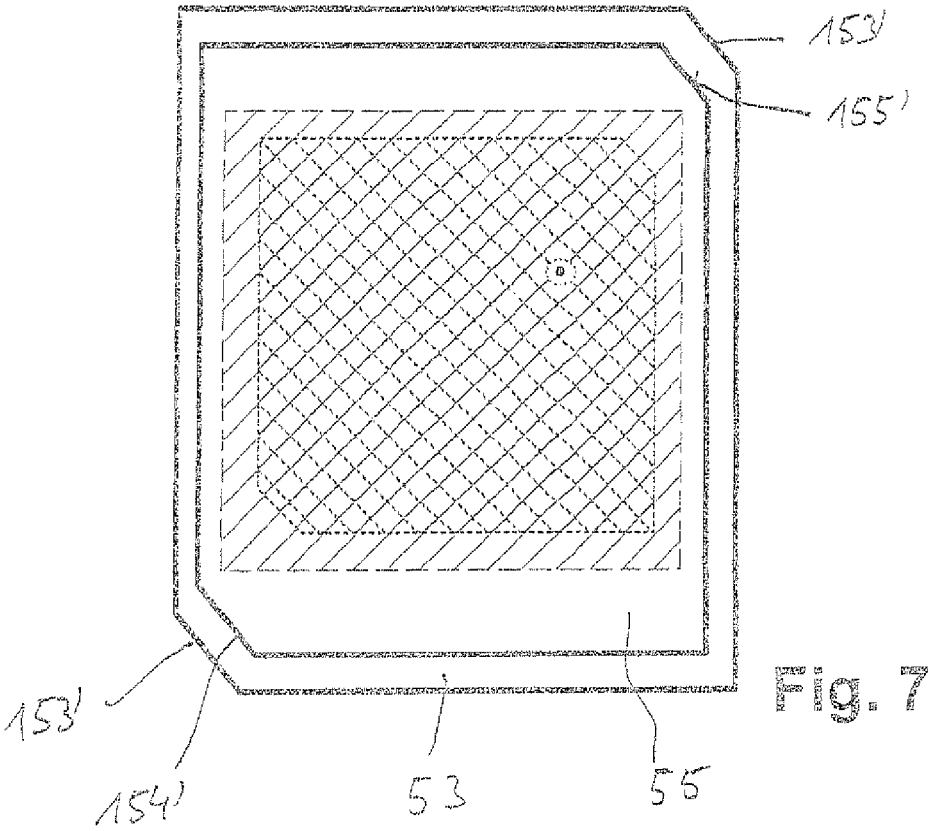
FIG. 7 is a schematic plan view of a modified exemplary embodiment from FIG. 2.

In conclusion, it will be noted merely in principle with reference to FIG. 7 that other geometric shapes and contours are conceivable not only for the upper radiation surface 7 but rather preferably also for the two mutually engageable patch means 53, 55.

In the exemplary embodiment according to FIG. 7, at least at two opposing regions, both the patch element 53 and the patch additional element 55 are provided with a shape which differs from a rectangular or square structure, in which flattenings 153' and 155' respectively are in this case provided at the corner regions. Nevertheless, generally speaking, the shapes of the outlines of both catch elements 53, 55 should be adapted to one another in such a way that they are in general at least similar to one another and allow optimum, as it were telescopic, engageability.

Described hereinbefore are exemplary embodiments in which, as has been shown in the drawings, the patch element 53 and the patch additional element 55 dip at least partly one inside the other. As mentioned hereinbefore, the two patch elements 53, 55 can also be arranged in such a way that the lower delimiting plane of the upper patch element and the upper delimiting plane of the lower patch element lie precisely in one plane or even in such a way that a distance is formed between these two delimiting planes. The arrangement should in this case be such that the maximum distance between the upper delimiting plane 53' of the primary patch element 53 and the lower delimiting plane 55' of the patch additional element 55 is less than 5 times the height 114*b* of the patch additional element 55, preferably is less than 4 times, 3 times, 2 times and in particular 1 times the height 114*b* of the patch additional element 55 or even is less than half the height 114*b*.

Figure 8:
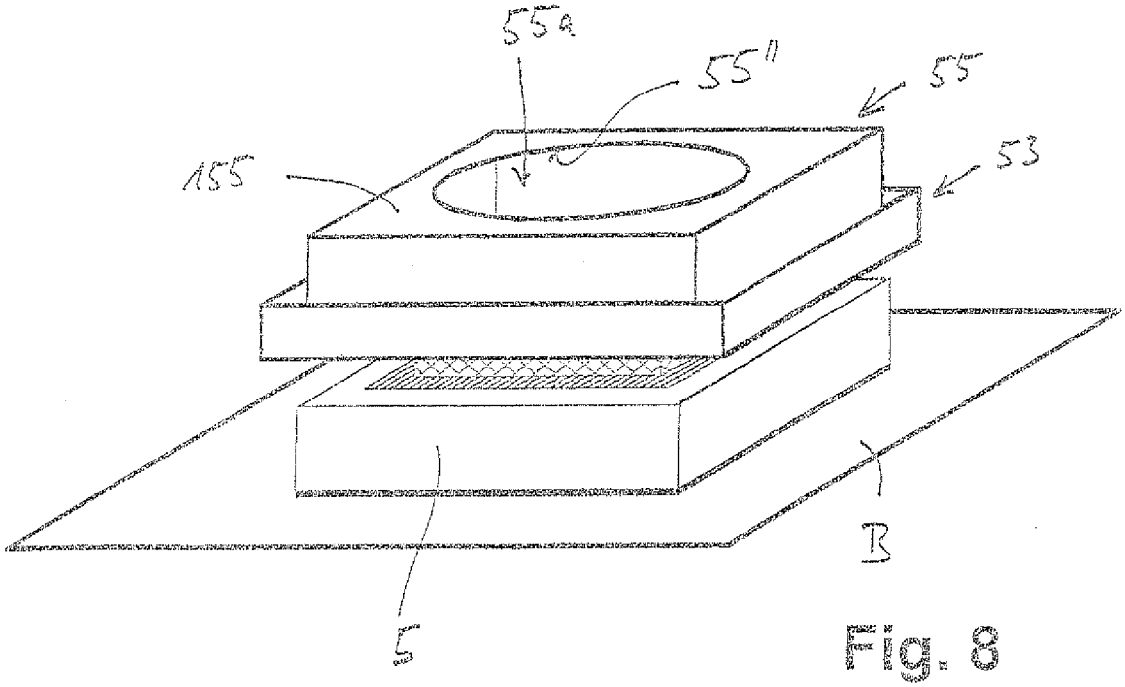
FIG. 8 is an exemplary embodiment differing from FIG. 3 with a patch additional element which, at the top, has a recess in the central surface.

Finally, it should also be noted, with regard to the exemplary embodiment according to FIG. 8 which shows, merely for the sake of completeness, possible modifications, that a recess or a cutout 55" may, for example, be formed also in the upper base surface or central surface 155 of the patch additional element 55. In the exemplary embodiment shown, this recess 55" is configured in the form of a round hole or circle.

The invention claimed is:

1. A multilayer antenna having a planar design, in particular a patch antenna preferably excluding an inverted F antenna, comprising a plurality of surfaces and/or layers arranged along an axial axis (Z) with or without lateral offset from one another comprising:

an electrically conductive earth surface a conductive radiation surface is arranged at a lateral distance from the earth surface and preferably extending parallel thereto, a dielectric carrier arranged between the earth surface and the radiation surface at least in a partial height and/or a partial region, optionally next to air, the radiation surface electrically connected to an electrically conductive feed line, a support means provided directly or indirectly on the side of the radiation surface opposing the earth surface, an electrically conductive patch assembly provided on the side of the support means opposing the radiation surface, the support means being a thickness or height which is less than an overall thickness or height of the patch assembly, the patch assembly comprising a primary patch element which is box-shaped or box-like in its configuration and comprises for this purpose, in addition to a base portion or central portion, elevations, edges and/or webs protruding transversely thereto, the patch assembly is divided at least into two and comprises, in addition to the primary patch element, a secondary patch additional element, the primary patch element and the patch additional element positioned toward one another and at least partly in one another to change the overall height thereof, and the patch additional element being held by a separate holding and support means, by a hood covering the entire antenna assembly.

2. The multilayer antenna as claimed in claim 1, wherein the patch additional element is arranged with its lower delimiting plane in such a way that the lower delimiting plane comes to lie at the level of or below the upper delimiting plane of the primary patch element.

3. The multilayer antenna as claimed in claim 1, wherein the patch additional element is arranged with its lower delimiting plane in such a way that the lower delimiting plane comes to lie above the upper delimiting plane of the primary patch element, at a maximum distance which is less than 5 times the height, preferably less than 4 times, 3 times, 2 times the height and in particular is less than the height of the patch additional element and preferably is less than half the height of the patch additional element.

4. The multilayer antenna as claimed in claim 1, wherein the length and/or width of the patch additional element is configured in such a way that the patch additional element can dip into the receiving chamber of the patch element, which receiving chamber is bordered by the central surface and the preferably peripheral elevations, edges and/or webs of the primary patch element.

5. The multilayer antenna as claimed in claim 1, wherein the length and width of the patch additional element are at least slightly less than the internal dimension of the receiving chamber of the patch element.

6. The multilayer antenna as claimed in claim 1, wherein the height of the primary patch element and the height of the patch additional element are the same or differ from one another by less than 50%, in particular less than 40%, 30%, 20% and in particular less than 10%.

7. The multilayer antenna as claimed in claim 1, wherein the length and/or the width of the primary patch element differ from the length and/or width of the patch additional element by less than 40%, in particular less than 30%, 20%, 10% and less than 5% and in particular less than 2%.

8. The multilayer antenna as claimed in claim 1, wherein the overall height of the patch assembly is less than the thickness or height of the dielectric carrier between the earth surface and the radiation surface.

9. The multilayer antenna as claimed in claim 1, wherein the overall height of the patch assembly is greater than the thickness or height of the dielectric carrier between the earth surface and the radiation surface, the thickness or height of the patch element corresponding to up 2, 3, 4, 5, 6, 7, 8, 9 or 10 and more times the thickness or height of the dielectric carrier.

10. The multilayer antenna as claimed in claim 1, wherein the primary patch element and/or the patch additional element have a longitudinal and/or transverse extension of the radiation surface that is greater than or equal to the longitudinal and/or transverse extension of the dielectric carrier and/or is greater than the longitudinal or transverse extension of the earth surface.

11. The multilayer antenna as claimed in claim 1, wherein the overall thickness or overall height of the patch assembly is greater than twice, greater than 3, 4 or 5 times, in particular greater than 6, 7, 8, 9 or 10 times and in particular greater than 20, 30, 40, 50, 60, 70, 80, 90 or 100 and more times the thickness of the earth surface and/or the thickness of the radiation surface.

12. The multilayer antenna as claimed in claim 1, wherein the primary patch element and/or the patch additional element are made of an electrically conductive material, in particular metal.

13. The multilayer antenna as claimed in claim 1, wherein the primary patch element and/or the patch additional element are made of an electrically non-conductive material and wholly or partly coated with an electrically conductive layer, at least the central or base portions and/or the peripheral lateral delimitations and/or the edges or webs provided with an electrically conductive layer.

14. The multilayer antenna as claimed in claim 1, wherein the primary patch element is at least approximately box-shaped in its configuration, namely with a central portion which is surrounded by an edge or web which is peripherally closed or configured in portions, the opening side of the box-shaped patch element thus formed lying pointing away from the radiation surface or the earth surface.

15. The multilayer antenna as claimed in claim 1, wherein the patch additional element is at least approximately box-shaped in its configuration, namely with a central portion which is surrounded by an edge or web which is peripherally closed or configured in portions, the opening side of the box-shaped patch additional element thus formed lying preferably pointing toward the radiation surface or the earth surface.

16. The multilayer antenna as claimed in claim 1, wherein the primary patch element and patch additional element, which can be positioned one inside the other in differing ways by adapting the overall height thereof, dip inside one another without contact or with mutual contact.

17. The multilayer antenna as claimed in claim 1, wherein the primary patch element, which has a central portion which is surrounded by an edge or web which is oriented away from the radiation surface, is arranged on the support means, and wherein the patch additional element, which is held via a separate support means, dips therein with relatively small outer dimensions.

18. The multilayer antenna as claimed in claim 1, wherein at least one of the two patch elements, preferably the patch additional element, is fastened to the inside of the hood, in particular is held by means of adhesion or a mechanical fastening, locking or clamping means.

19. The multilayer antenna as claimed in claim 1, wherein a separate support means and/or fastening means is provided on the inside of the hood, preferably in the form of the patch additional element, for fixing the adjacent patch element.

20. The multilayer antenna as claimed in claim 1, wherein a recess, preferably a circular recess, is formed in the patch additional element, on the base surface or central surface thereof.

* * * * *